US009051679B2

(12) United States Patent
Kwon et al.

(10) Patent No.: US 9,051,679 B2
(45) Date of Patent: Jun. 9, 2015

(54) LAUNDRY MACHINE

(75) Inventors: Ig Geun Kwon, Changwon-si (KR); Soo Bong Kim, Changwon-si (KR); Min Gyu Jo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 851 days.

(21) Appl. No.: 13/259,832

(22) PCT Filed: May 27, 2010

(86) PCT No.: PCT/KR2010/003376
§ 371 (c)(1),
(2), (4) Date: Sep. 23, 2011

(87) PCT Pub. No.: WO2010/137892
PCT Pub. Date: Dec. 2, 2010

(65) Prior Publication Data

US 2012/0011893 A1 Jan. 19, 2012

(30) Foreign Application Priority Data

May 28, 2009 (KR) ..... 10-2009-0047192
Aug. 27, 2009 (KR) ..... 10-2009-0079949
May 11, 2010 (KR) ..... 10-2010-0043965
May 11, 2010 (KR) ..... 10-2010-0043966

(51) Int. Cl.
*D06F 37/26* (2006.01)

(52) U.S. Cl.
CPC ..... *D06F 37/263* (2013.01); *D06F 37/262* (2013.01); *D06F 37/266* (2013.01); *D06F 37/267* (2013.01)

(58) Field of Classification Search
CPC ..... D06F 37/266; D06F 37/263
USPC ..... 68/24, 58, 139, 140
See application file for complete search history.

(56) References Cited

U.S. PATENT DOCUMENTS

| | | | | |
|---|---|---|---|---|
| 3,275,152 | A | 9/1966 | Searle | 210/64 |
| 3,387,310 | A | 6/1968 | Marshall | 8/158 |
| 3,509,742 | A | 5/1970 | Bauer | 68/23.1 |
| 4,033,047 | A | 7/1977 | Kawai | 34/82 |
| 4,204,339 | A | 5/1980 | Muller | 34/75 |
| 4,891,892 | A | 1/1990 | Narang | 34/86 |

(Continued)

FOREIGN PATENT DOCUMENTS

| | | | |
|---|---|---|---|
| CN | 1179489 | A | 4/1998 |
| CN | 1508349 | A | 6/2004 |

(Continued)

OTHER PUBLICATIONS

United States Office Action dated Nov. 14, 2013 issued in U.S. Appl. No. 13/266,838.

(Continued)

*Primary Examiner* — Joseph L Perrin
(74) *Attorney, Agent, or Firm* — Ked & Associates, LLP

(57) ABSTRACT

A laundry machine is disclosed. The laundry machine includes a tub comprising a front surface part (112) having an opening formed in a center thereof to introduce laundry therein, a drum rotatably provided in the tub, the drum having an opening formed therein to load the laundry therein, and a gasket (200) provided between an inner surface of the front surface of the tub and a front end of the opening of the drum. The gasket (200) comprises a plurality of ribs (205*a*, 205*b*, 205*c*) arranged along a radial direction.

32 Claims, 12 Drawing Sheets

(56) References Cited

U.S. PATENT DOCUMENTS

| | | | | |
|---|---|---|---|---|
| 4,899,462 | A | 2/1990 | Putnam et al. | 34/19 |
| 5,231,805 | A | 8/1993 | Sander | 51/429 |
| 5,259,218 | A | 11/1993 | Broadbent | 68/12.06 |
| 5,582,040 | A | 12/1996 | Khan | 68/23.2 |
| 5,711,170 | A | 1/1998 | Johnson | 68/3 |
| 5,735,006 | A | 4/1998 | Vande Haar | 8/158 |
| 6,256,823 | B1 * | 7/2001 | Kronbetter et al. | 8/158 |
| 6,557,383 | B1 | 5/2003 | Ito et al. | 68/23.2 |
| 7,251,963 | B2 * | 8/2007 | Kim et al. | 68/196 |
| 7,398,662 | B2 * | 7/2008 | Kim et al. | 68/23 A |
| 8,468,711 | B2 | 6/2013 | Kim et al. | 34/82 |
| 2004/0107742 | A1 * | 6/2004 | Kim et al. | 68/24 |
| 2004/0123631 | A1 | 7/2004 | Chang | |
| 2004/0148978 | A1 * | 8/2004 | Kim et al. | 68/23 A |
| 2004/0163426 | A1 * | 8/2004 | Kim et al. | 68/23 A |
| 2004/0221474 | A1 | 11/2004 | Slutsky et al. | 34/319 |
| 2004/0226321 | A1 | 11/2004 | Park et al. | 68/23.1 |
| 2004/0261469 | A1 | 12/2004 | Park et al. | 68/23 |
| 2005/0183472 | A1 | 8/2005 | Choi | 68/23.1 |
| 2005/0262879 | A1 * | 12/2005 | Kim et al. | 68/3 R |
| 2005/0274159 | A1 | 12/2005 | Jeon et al. | 68/23.1 |
| 2006/0010935 | A1 | 1/2006 | Park et al. | 68/3 |
| 2006/0016228 | A1 | 1/2006 | Chang et al. | 68/23.1 |
| 2006/0053838 | A1 | 3/2006 | Inuzuka et al. | 68/3 |
| 2006/0075791 | A1 | 4/2006 | Seo et al. | 68/23.1 |
| 2006/0101865 | A1 | 5/2006 | Jeon et al. | 68/3 |
| 2006/0169006 | A1 * | 8/2006 | Lim et al. | 68/13 R |
| 2006/0174663 | A1 * | 8/2006 | Cimetta et al. | 68/3 R |
| 2006/0174665 | A1 | 8/2006 | Namkung et al. | 68/140 |
| 2007/0051142 | A1 * | 3/2007 | Lim et al. | 68/139 |
| 2007/0074543 | A1 | 4/2007 | Lim et al. | 68/140 |
| 2007/0227200 | A1 | 10/2007 | Kim et al. | 68/140 |
| 2007/0289339 | A1 | 12/2007 | Lim | 68/23.1 |
| 2008/0099052 | A1 | 5/2008 | Lee et al. | |
| 2008/0264114 | A1 * | 10/2008 | Jang et al. | 68/139 |
| 2008/0307833 | A1 | 12/2008 | Chang et al. | 68/23.1 |
| 2009/0178445 | A1 * | 7/2009 | Brinkmann | 68/23 A |
| 2011/0173834 | A1 | 7/2011 | Arrigoni et al. | 34/90 |
| 2013/0139402 | A1 | 6/2013 | Hong | 34/427 |
| 2013/0255099 | A1 | 10/2013 | Cavarretta et al. | 34/108 |

FOREIGN PATENT DOCUMENTS

| | | | |
|---|---|---|---|
| CN | 1511996 | A | 7/2004 |
| CN | 1540085 | A | 10/2004 |
| CN | 1548627 | A | 11/2004 |
| CN | 1707010 | A | 12/2005 |
| CN | 1724742 | A | 1/2006 |
| CN | 1730776 | A | 2/2006 |
| CN | 1730777 | A | 2/2006 |
| CN | 1730778 | A | 2/2006 |
| CN | 1844543 | A | 10/2006 |
| CN | 1906351 | A | 1/2007 |
| CN | 1940166 | A | 4/2007 |
| CN | 101046046 | A | 10/2007 |
| CN | 101381946 | A | 3/2009 |
| DE | 25 03 576 | A1 | 8/1976 |
| DE | 3438575 | A1 | 4/1986 |
| DE | 41 04 450 | A1 | 8/1992 |
| DE | 44 13 069 | A1 | 10/1994 |
| DE | 297 16 968 | U1 | 11/1997 |
| DE | 198 56 973 | A1 | 6/1999 |
| DE | 103 42 254 | B3 | 11/2004 |
| DE | 10 2006 012 035 | B3 | 3/2007 |
| DE | 10 2006 031 352 | A1 | 1/2008 |
| EP | 0 152 745 | A2 | 8/1985 |
| EP | 0 443 361 | A1 | 8/1991 |
| EP | 0 648 885 | A1 | 4/1995 |
| EP | 1 079 014 | A1 | 2/2001 |
| EP | 1 270 791 | A2 | 1/2003 |
| EP | 1 433 890 | A2 | 6/2004 |
| EP | 1 445 368 | A2 | 8/2004 |
| EP | 1 529 869 | A2 | 5/2005 |
| EP | 1 605 088 | A2 | 12/2005 |
| EP | 1 619 286 | A2 | 1/2006 |
| EP | 1 688 524 | A1 | 8/2006 |
| EP | 1 688 525 | A1 | 8/2006 |
| EP | 1 688 531 | A1 | 8/2006 |
| EP | 1 690 969 | A1 | 8/2006 |
| EP | 1 710 340 | A2 | 10/2006 |
| EP | 1 722 025 | A1 | 11/2006 |
| EP | 1 746 192 | A2 | 1/2007 |
| EP | 1 770 199 | A2 | 4/2007 |
| EP | 1 840 257 | A1 | 10/2007 |
| EP | 1 857 583 | A1 | 11/2007 |
| EP | 1 881 099 | A1 | 1/2008 |
| EP | 1 975 298 | A1 | 10/2008 |
| EP | 2 053 157 | A1 | 4/2009 |
| EP | 2 075 364 | A1 | 7/2009 |
| EP | 2 078 777 | A1 | 7/2009 |
| EP | 2 390 401 | A2 | 11/2011 |
| EP | 2 435 624 | A2 | 4/2012 |
| FR | 2 931 489 | A1 | 11/2009 |
| GB | 913801 | A | 12/1962 |
| GB | 1181797 | A | 2/1970 |
| GB | 2 091 123 | A | 7/1982 |
| GB | 2 279 968 | A | 1/1995 |
| JP | H10-211393 | A | 8/1998 |
| JP | 3502039 | B2 | 3/2004 |
| JP | 2006-061613 | A | 3/2006 |
| JP | 2008-006045 | A | 1/2008 |
| JP | 2008-259665 | A | 10/2008 |
| JP | 2009-028400 | A | 2/2009 |
| JP | 2009-060990 | A | 3/2009 |
| KR | 10-2003-0092185 | A | 12/2003 |
| KR | 10-2005-0108609 | A | 11/2005 |
| KR | 10-2006-0095816 | A | 9/2006 |
| KR | 10-2007-0059431 | A | 6/2007 |
| KR | 10-2007-0101732 | A | 10/2007 |
| KR | 10-2008-0002475 | A | 1/2008 |
| KR | 10-0808192 | B1 | 2/2008 |
| KR | 10-2008-0072187 | | 8/2008 |
| KR | 10-2008-0072187 | A | 8/2008 |
| RU | 2 085 641 | C1 | 7/1997 |
| RU | 2 182 197 | C2 | 5/2002 |
| RU | 2 303 092 | C1 | 7/2007 |
| RU | 2 303 668 | C2 | 7/2007 |
| WO | WO 01/96647 | A1 | 12/2001 |
| WO | WO 2005/017249 | A1 | 2/2005 |
| WO | WO 2007/105843 | A1 | 9/2007 |
| WO | WO 2008/007888 | A2 | 1/2008 |
| WO | WO 2008003592 | A1 * | 1/2008 |
| WO | WO 2008/103007 | A2 | 8/2008 |
| WO | WO 2009/040302 | A1 | 4/2009 |
| WO | WO 2009/050095 | A1 | 4/2009 |
| WO | WO 2009/148251 | A2 | 12/2009 |

OTHER PUBLICATIONS

International Search Report and Written Opinion dated Sep. 14, 2010 issued in Application No. PCT/KR2009/007869.

International Search Report and Written Opinion dated Oct. 27, 2010 issued in Application No. PCT/KR2010/003379.

International Search Report and Written Opinion dated Oct. 27, 2010 issued in Application No. PCT/KR2010/003400.

International Search Report and Written Opinion dated Nov. 24, 2010 issued in Application No. PCT/KR2010/003376.

International Search Report and Written Opinion dated Nov. 24, 2010 issued in Application No. PCT/KR2010/003377.

International Search Report and Written Opinion dated Nov. 24, 2010 issued in Application No. PCT/KR2010/003378.

International Search Report and Written Opinion dated Nov. 29, 2010 issued in Application No. PCT/KR2010/003404.

International Search Report and Written Opinion dated Nov. 29, 2010 issued in Application No. PCT/KR2010/003405.

International Search Report and Written Opinion dated Nov. 29, 2010 issued in Application No. PCT/KR2010/003409.

International Search Report and Written Opinion dated Nov. 29, 2010 issued in Application No. PCT/KR2010/003410.

International Search Report and Written Opinion dated Jan. 21, 2011 issued in Application No. PCT/KR2010/003406.

(56) References Cited

OTHER PUBLICATIONS

International Search Report and Written Opinion dated Jan. 31, 2011 issued in Application No. PCT/KR2010/003408.
International Search Report and Written Opinion dated Jul. 19, 2011 issued in Application No. PCT/KR2009/007963.
International Search Report and Written Opinion dated Sep. 21, 2011 issued in Application No. PCT/KR2009/007960.
European Search Report dated Jul. 31, 2012 issued in Application No. 09 83 6377.
European Search Report dated Feb. 25, 2014 issued in Application No. 10 78 0803.2.
European Search Report dated Feb. 25, 2014 issued in Application No. 10 78 0805.7.
European Search Report dated Feb. 26, 2014 issued in Application No. 10 78 0804.0.
European Search Report dated Feb. 26, 2014 issued in Application No. 10 78 0806.5.
European Notice of Allowance dated Feb. 28, 2014 issued in Application No. 10 78 0823.0.
European Search Report dated Mar. 19, 2014 issued in Application No. 13 19 8677.0.
United States Office Action dated Apr. 11, 2014 issued in U.S. Appl. No. 13/320,697.
Chinese Office Action dated Mar. 28, 2013 issued in Application No. 201080021257.5 (with English translation).
International Search Report issued in PCT Application No. PCT/KR2010/003376 dated Nov. 24, 2010.
Chinese Office Action dated Dec. 25, 2012 issued in Application No. 200980155851.0 (with English translation).
Chinese Office Action dated Dec. 28, 2012 issued in Application No. 200980155608.9 (with English translation).
European Office Action dated Jan. 2, 2014 issued in Application No. 10 780 822.2.
Russian Office Action dated Jan. 22, 2014 issued in Application No. 2011132074 (with English translation.).
Russian Office Action dated Jan. 30, 2014 issued in Application No. 2011147481 (with English translation).
European Office Action dated Feb. 5, 2014 issued in Application No. 10 780 817.2.
Chinese Office Action dated Mar. 5, 2013 issued in Application No. 201080017293.4 (with English translation).
Russian Decision to Grant a Patent dated May 15, 2014 issued in Application No. 2011147481 (with English translation).
United States Office Action dated Jun. 12, 2014 issued in U.S. Appl. No. 13/318,655.
United States Office Action dated Jun. 17, 2014 issued in U.S. Appl. No. 13/258,965.
Chinese Office Action dated Jun. 4, 2013 issued in Application No. 201080021259.4 (with English translation).
Chinese Office Action dated Jun. 4, 2013 issued in Application No. 201080022490.5 (with English translation).
European Search Report dated Oct. 19, 2012 issued in Application No. 10 78 0817.
European Search Report dated Oct. 22, 2012 issued in Application No. 10 78 0819.
European Search Report dated Oct. 24, 2012 issued in Application No. 10 78 0823.
European Search Report dated Oct. 26, 2012 issued in Application No. 10 78 0820.
United States Office Action dated Aug. 4, 2014 issued in U.S. Appl. No. 13/318,655.
United States Office Action dated Sep. 3, 2014 issued in U.S. Appl. No. 13/142,620.
United States Office Action dated Sep. 9, 2014 issued in U.S. Appl. No. 13/259,709.
Russian Decision to Grant a Patent dated Aug. 29, 2014 issued in Application No. 2011146320/12 (with English translation).
Russian Decision to Grant a Patent dated Aug. 29, 2014 issued in Application No. 2011147482/12 (with English translation).
United States Office Action dated Nov. 6, 2014 issued in U.S. Appl. No. 13/142,986.
United States Office Action dated Nov. 18, 2014 issued in U.S. Appl. No. 13/143,032.
United States Office Action dated Nov. 20, 2014 issued in U.S. Appl. No. 13/259,016.
United States Office Action dated Dec. 29, 2014 issued in U.S. Appl. No. 13/266,895.
United States Final Office Action dated Jan. 9, 2015 issued in U.S. Appl. No. 13/318,655.
United States Final Office Action dated Jan. 21, 2015 issued in U.S. Appl. No. 13/142,620.
ABT-MAH2400WH.pdf, web page posted on www.abt.com on Mar. 2009; https://web.archive.org/web/20090301015816/http://www.abt.com/ product/17027/Maytag-MAH2400AWW.html; retrieved by Examiner on Mar. 19, 2015.
Maytag-MAH2400AWW.pdf, web page posted on www.maytag.com on May 2005; https://web.archive. org./web /20050502164236/ http:/ /www.maytag.com/mths/products/product.jsp?model=MAH2400AWWW;.retrieved by Examiner on Mar. 19, 2015.
Amazon-MAH2400AWW.pdf, web page posted on www.amazon.com on Mar. 2015; http:/www.amazon.com/Maytag-MAH2400AWWCompact-Front-Load-Capacity/dp/ 8000UVYEOM/ref=cm cd ql qh dp t;.retrieved by Examiner on Mar. 19, 2015.
United States Office Action dated Feb. 5, 2015 issued in U.S. Appl. No. 13/319,167.
United States Final Office Action dated Mar. 16, 2015 issued in U.S. Appl. No. 13/143,032.
United States Final Office Action dated Mar. 24, 2015 issued in U.S. Appl. No. 13/259,016.
United States Office Action dated Mar. 26, 2015 issued in U.S. Appl. No. 13/318,549.
United States Final Office Action dated Apr. 9, 2015 issued in U.S. Appl. No. 13/320,697.

* cited by examiner

LAUNDRY MACHINE

CROSS-REFERENCE TO RELATED PATENT APPLICTIONS

This application is a U.S National Stage Application under 35 U.S.C. §371 of PCT Application No. PCT/KR2010/003376, filed May 27, 2010, which claims priority to Korean Patent Application Nos. 10-2009-0047192, filed May 28, 2009, 10-2009-0079949, filed Aug. 27, 2009, 10-2010-0046965, filed May 11, 2010 and 10-2010-0046966, filed May 11, 2010 whose entire disclosures are hereby incorporated by reference.

TECHNICAL FIELD

The present invention relates to a laundry machine.

BACKGROUND ART

Generally, a drum type laundry machine includes a tub horizontally arranged therein and a drum also horizontally oriented therein. Laundry is loaded in the drum and the laundry is tumbled as the drum is rotated, to be washed. Here, the tub is employed to accommodate wash water and the drum is employed to receive the laundry and washing is implemented in the drum. The drum is rotatably installed in the tub and a shaft is connected with a rear surface of the drum. A rotational force is transmitted to the shaft from a motor. The rotational force generated by rotation of the motor is transmitted to the drum via the shaft to rotate the drum. As a result, the drum is rotated not only in a washing course but also in rinsing and dry-spinning courses. Here, the drum is vibrated during the rotation.

However, such a shaft provided in a conventional laundry machine is projected outside of the tub, passing through a rear wall surface of the tub and the shaft is rotatably supported by a bearing housing. The bearing housing is connected with the rear wall surface of the tub rigidly. Because of that, the vibration of the drum is directly transmitted to the tub and a suspension unit is provided in the conventional drum type machine to suspend the vibration. Typically, the suspension unit is connected with the tub and it suspendingly supports the vibration of the tub. According to a mechanism of the conventional laundry machine, the vibration generated by the rotation of the drum is transmitted to the tub and it is suspended by the suspension unit.

DISCLOSURE OF INVENTION

Technical Problem

A tub of a laundry machine according to an embodiment of the present invention includes an opening configured to introduce laundry. A flexible material may be installed in a front part of the tub having the opening formed therein to prevent wash water from flowing via the opening or to prevent laundry or foreign substances from being stuck between the tub and a drum, or to implement another function. An object of the present invention is to provide a laundry machine including a flexible material with a new structure, in relation to the above flexible material.

Solution to Problem

To achieve these objects and other advantages and in accordance with the purpose of the invention, as embodied and broadly described herein, a laundry machine includes a tub comprising a font surface part having an opening formed in a center thereof to introduce laundry therein; a drum rotatably provided in the tub, the drum having an opening formed therein to load the laundry therein; and a gasket provided between an inner surface of the front surface of the tub and a front end of the opening of the drum, the gasket comprising a plurality of ribs arranged along a radial direction.

Here, the gasket may include a flange extendedly formed to be seated in the inner surface of the front surface of the tub. The plurality of the ribs may be provided in a rear portion of the flange. The plurality of the ribs may include at least three ribs. For example, the plurality of the ribs may include a first rib, a second rib and a third rib provided in a center of the gasket sequentially.

The lengths of the ribs may be getting smaller as coming farther from the center of the gasket. The length of the first rib may be larger than the lengths of the second and third ribs. The first rib may be extended a predetermined distance toward an inside of the opening formed in the drum. In this case, the first rib may be extended beyond the front end of the drum. The first rib may have a predetermined length enough to cover a predetermined portion of the front end of the drum. The length of the first rib may be determined enough not to interfere with a locus of an upward and downward movement generated by the rotation of the drum.

Each of the first, second and third ribs may have a predetermined length enough not to contact with the front end of the drum in case the drum is normally rotated in a dry-spinning course. Each of the first, second and third ribs may have a predetermined length enough to contact with a predetermined portion of the front end of the drum, in case the drum is over-rotated in a dry-spinning course, and not to contact the front end of the drum, in case the drum is normally rotated.

In the meanwhile, the laundry machine may further include a reinforcing rib configured to support the first, second or third rib in an outer direction of the third rib.

The plurality of the ribs may be provided in a rear bottom portion of the flange provided in the gasket. For example, the plurality of the ribs may be provided to correspond a 180° to 270° area of a rear bottom portion of the flange provided in the gasket. The plurality of the ribs may be getting shorter upward from a lower portion of the gasket. The ribs provided in the lower portion of the gasket may be more than the ribs provided in the upper portion of the gasket.

In another embodiment of the present invention, the laundry machine may further include a fourth rib provided in a upper 180° area to 270° area of a rear portion of the flange. The fourth rib may be outer than the first rib in case it is overlapped with the area of the first rib. The laundry machine may further include a fifth rib configured to surround the fourth rib. The fifth rib may be connected with the second rib or third rib, to be extended backward to a rear top of the flange. In case a connection part provided between ends of the second rib and third rib, the fifth rib may be connected with the connection part. The laundry machine may further include a sixth rib configured to surround the fifth rib. The sixth rib may be formed corresponding to a lower 180° area of a rear portion of the flange.

The laundry machine may further include a compensating rib provided in an inner surface of the front surface of the tub to compensate a cut length of the fifth rib, in case the fifth rib is cut because a top of the flange has a cut length.

The plurality of the rib may be arranged in at least three steps in a predetermined angle area of a lower part of the gasket. The plurality of the ribs may be arranged in two steps or more, corresponding to an overall front end of the drum.

Each sectional shape of the ribs may have a smaller thickness from a connected portion with the flange toward an end portion. Specifically, each end of the ribs may be bent inwardly with respect to a radial direction.

According to the laundry machine, a suspension assembly may be connected with the driving part to suspendingly support the vibration of the drum. According to a conventional laundry machine, a suspension assembly is connected with the tub to suspend the vibration of the tub and the vibration of the drum together. However, according to the present invention, the vibration of the drum may be separated from the vibration of the tub. The suspension assembly may include a radial bracket extended in a radial direction from the bearing housing connected therewith and a shaft bracket extended forwardly or in a shaft direction of the drum, connected with the radial bracket. The right and left couple of such the radial bracket and shaft bracket may be provided. In addition, a suspension unit may be provided and the suspension unit may be connected with the shaft bracket or the bearing housing.

In the meanwhile, the tub may be supported more rigidly than the drum is supported by the suspension assembly. Examples of tubs supported more rigidly than the supporting of the suspension assembly will be followed.

First of all, a predetermined portion of the tub may be integrally formed with the cabinet.

Second, the tub may be connected and supported by a screw, rivet, rubber bushing and the like or fixedly welled, adhered or sealed. In this case, the rigidity of the suspension unit is stronger than the rigidity of these connecting materials with respect to a vertical direction which is a main vibration direction of the drum.

In the meanwhile, a flexible material may be provided to reduce the vibration of the drum transmitted to the tub. The flexible material may connect the tub with the driving part flexibly, to prevent water from leaking to the driving part from the tub and to allow the driving part to relative-move with respect to the tub. This flexible material may be configured of a rear gasket.

Advantageous Effects of Invention

The present invention has following advantageous effects. The laundry machine according to the present invention may prevent was water from leaking efficiently and to prevent foreign substances or laundry from being drawn between the tub and the drum efficiently.

BRIEF DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

Figure 1:
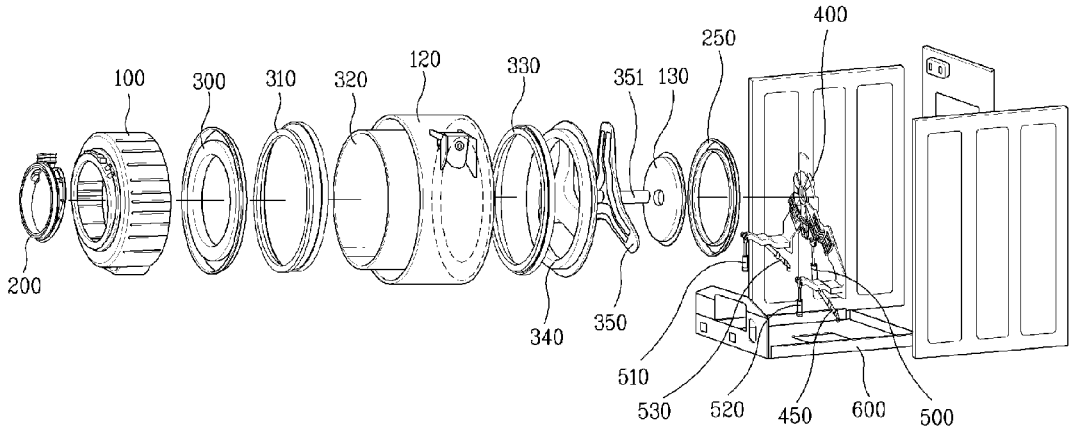
FIG. 1 is an exploded perspective view illustrating a laundry machine according to an exemplary embodiment of the present invention.

FIG. 1 is an exploded perspective view illustrating a laundry machine according to an exemplary embodiment of the present invention.

A laundry machine according to following embodiments of the present invention may include a tub fixedly supported to a cabinet or a tub supported to a cabinet via a flexible structure such as suspension unit which will be described later, not fixedly secured thereto, as shown in FIG. 1. Also, the supporting structure of the sub may be between the supporting via the suspension unit and the complete fixing structure. That is, the tub may be supported flexibly via the suspension unit which will be described later, it may be supported fixedly to be a more rigidly supported state than the above flexible supported state.

Although not shown in the drawings, a cabinet may not be provided in a laundry machine, different from following embodiment. For example, an installation space of a built-in type laundry machine may be defined by a wall structure in stead of a cabinet. That is, a cabinet configured to form an independent exterior appearance may not be provided.

In reference to FIG. 1, a tub may include a tub front 100 and a tub rear 120 composing a rear portion of the tub front 100.

The tub front 100 and the tub rear 120 may be assembled by screws and a predetermined space is formed therein to accommodate a drum. The tub rear 120 includes an opening formed in a rear surface thereof and a rear gasket 250 may be connected to an inner circumference of the opening. The rear gasket 250 may be connected to a tub back 130 and the tub back 130 may include a through-hole having a shaft pass through a center thereof.

The rear gasket 250 is sealed and connected to each of the tub back 130 and the tub rear 120 to prevent wash water inside the tub from leaking. The tub back 130 is vibrating when the drum is rotated. At this time, the tub back 130 may be distant from the tub rear 120 a predetermined distance not to interfere with the tub rear 120. Also, the rear gasket 250 may be formed of flexible material to enable the tub back 130 to relative-move, not interfering with the tub rear 120. The rear gasket 250 may include a corrugated part which is extendible to an enough length to allow the relative motion of the tub back 130.

This embodiment presents the rear gasket 250 connected to the tub back 130 and the present invention is not limited thereto. The rear gasket 250 is configured to seal the gap between the tub and a driving part (not shown) including a shaft 351 and a bearing housing 400 and to allow the driving part to relative-move with respect to the tub. As a result, the shapes and the connected objects of the rear gasket 250 may be variable unlimitedly, only if this function is enabled.

In the meanwhile, a flexible material 200 which will be described as front gasket later may be installed in a front portion of the tub front 100.

The drum may be configured of a front 300, a drum center 320 and a drum back 340. Ball balancers 310 and 330 may be installed in front and rear portions of the drum, respectively. The drum back 340 may be connected to a spider 350 and the spider 350 may be connected to the shaft 351. The drum is rotatable within the tub by a rotational force transmitted via the shaft 351.

The shaft 351 may be connected to a motor (not shown), passing through the tub back 130. According to the present invention, the motor may be connected to the shaft 351 concentrically. That is, the motor may be directly connected to the shaft 351 according to this embodiment. More specifically, a rotor of the motor may be directly connected to the shaft 351. Of course, the motor and the shaft 351 may be indirectly connected with each other, for example, they may be connected by a belt.

The bearing housing 400 may be secured to a rear surface 128 of the tub back 130 and it may be employed to rotatably support the shaft, between the motor and the tub back 130.

A stator (not shown) may be fixedly secured to the bearing housing 400. And the rotor may be located around the stator. As mentioned above, the rotor may be directly connected to the shaft 351. Here, the motor may be configured of an outer rotor type motor and it may be connected with the shaft directly.

The bearing housing 400 may be supported by a base 600 via the suspension unit. The suspension unit may include a perpendicular suspension and an oblique suspension configured to support the bearing housing 400 with respect to a forward and backward direction. For example, the suspension unit according to this embodiment may include three perpendicular suspensions 500, 510 and 520 and two oblique suspensions 450 and 530 configured to support the bearing housing 400 with respect to a forward and backward direction. Here, the suspension unit may be connected to the base 600 with a predetermined elastic transformation enabling a forward/backward and/or rightward/leftward movement of the drum, not connected fixedly. That is, the suspension unit may be supported by the base, with a predetermined elasticity enough to be allowed to rotate at a predetermined angle in forward/backward and rightward/leftward directions with respect to the points connected with the base. For such the elastic supporting, the perpendicular suspension may be installed to the base by the media of a rubber bushing.

The perpendicular suspension of the suspension unit may suspend the vibration of the drum elastically and the oblique suspension may dampen the vibration. That is, the perpendicular suspension may be used as spring and the oblique suspension as damping means in a vibration system including a spring and damping means.

The tub is supported to the cabinet and the vibration of the drum may be dampenedly supported by the suspension unit. As a result, the laundry machine according to this embodiment may have a substantially independent supporting structure between the tub and the drum or it may have a structure having the vibration of the drum not directly transmitted to the tub.

As follows, the structures of the tub front and the front gasket and the connection there between will be described in detail in reference to corresponding drawings.

Figure 2:
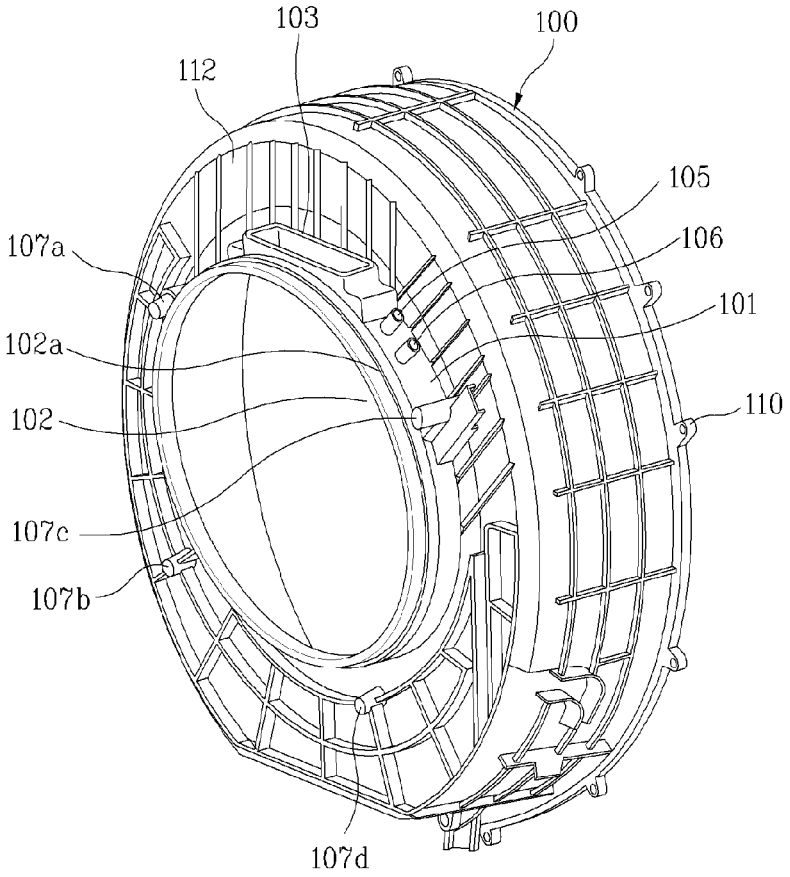
FIGS. 2 and 3 are front perspective views illustrating a tub front.
Figure 3:
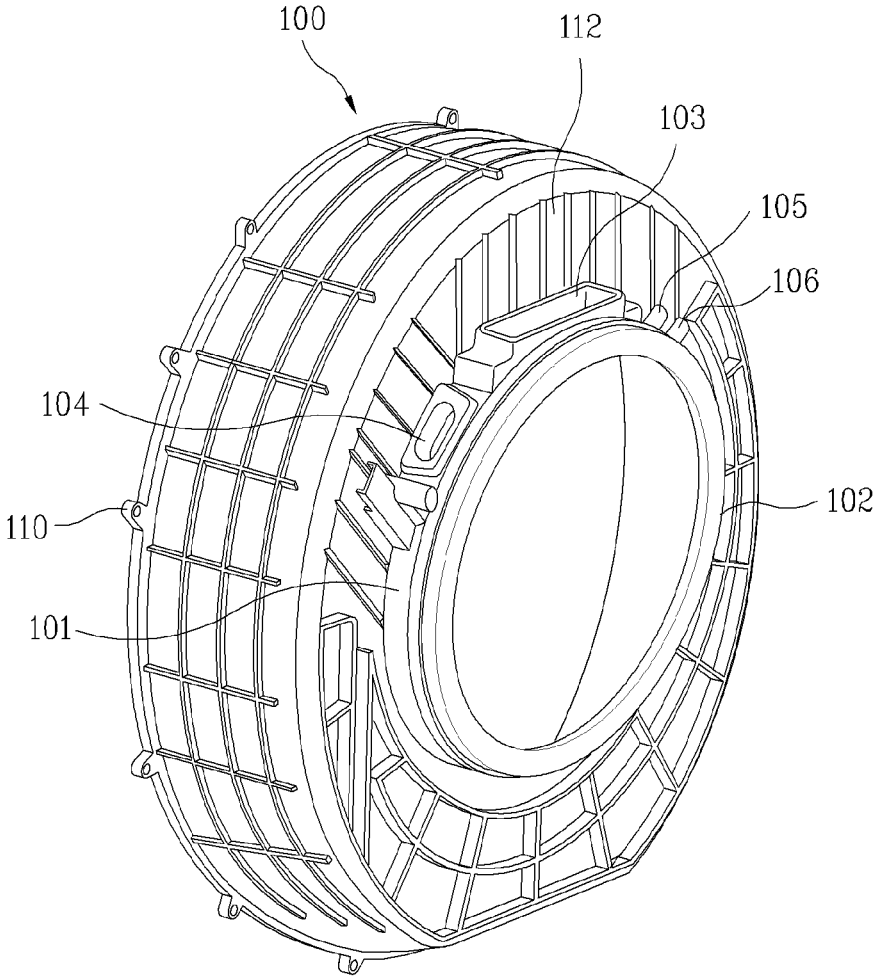

FIGS. 2 and 3 are front perspective views illustrating the tub front 100.

In reference to FIGS. 2 and 3, the tub front 100 mentioned above may include a mostly flat front surface 112 of a donut shape provided in a front portion of a cylindrical surface composing a predetermined portion of a side wall of the tub. A rear portion of the cylindrical surface is open-stated as it is and the rear portion may include a plurality of securing holes 110. The securing holes 110 may be secured to corresponding securing holes of the tub rear 120.

In the meanwhile, the lower width of the tub front 100 may be larger than the upper width thereof with respect to the opening. That is, the lower width of the front surface 112 composing the tub front 100 may be larger than the upper width thereof. There may be more possibilities of foreign substance or laundry stuck between the drum and the tub in a lower portion of the drum front end according to this embodiment, which will be described in detail. Because of that, the lower width of the tub front 100 may be enlarged correspondingly and a foreign substance preventing part, which will be described later, may be provided in the enlarged portion.

The front surface 112 of the tub front 100 may include an opening configured to enable laundry loaded therein or unloaded there from. A rim 101 may be extended forwardly along the opening. The forward/backward width of the rim 101 may be getting narrower downward. Because of that, the rim 101 may not be formed in a lower portion of the front surface 112 substantially.

A water inlet 104 configured to supply wash water, a hot air inlet 103 which will be used in a drying process, a circulating-water inlet 106 configured to draw the wash water circulated by a circulation pump, and/or a steam inlet 105 configured to draw steam may be formed in the rim 101. The hot air inlet 103 may be projected upward from the rim 101 in an approximately square shape. Here, the hot air inlet 103 will be required by a laundry machine having washing and drying functions and it will not be required by a laundry machine having no drying function.

Since the water inlet 104 and the other holes are formed in the front portion of the tub front 100, the supply of wash water and the like may be implemented in the front portion of the tub. The water inlet 104 and the other holes may be located in front of a front end of the drum held in the tub. As a result, for example, wash water may be directly drawn into the drum inside via the opening of the drum. Fluidal material supplied to treat the laundry such as wash water can be drawn into the drum inside directly and this makes possible more efficient treating for the laundry. In case detergent is supplied to the drum inside via a detergent box together with the wash water, the detergent will be directly drawn into the drum inside and the detergent usage amount may be reduced accordingly. As a result, the wash water amount may be reduced and a problem of tub inside contamination because of detergent remnant accumulating in a bottom of the tub may be reduced accordingly. In addition, if water is supplied via the front portion of the tub, a door glass (not shown) may be washed by the supplied water advantageously.

Even if hot air is supplied via the front portion of the tub, a perpendicular surface of the tub front 100, that is, a front surface thereof, the hot air flow may be '⊏' shaped, which is a complex air path formed by the hot air re-bent toward a perpendicular front surface of the tub after hot air having flown from the rear portion of the tub is bent downward from a front portion of a upper part of the tub. This 'ㄷ' shaped air path will not be helpful to efficient hot air flow. However, when the hot air inlet 103 is formed in the rim 101 of the tub front 100, the hot air may be bend perpendicularly one time and it may flow smoothly.

The water inlet 104 and the other holes may be located beyond a center of the drum. Because of that, the wash water and the like may be supplied to the drum inside from a front upper portion of the drum. If it is necessary to supply the wash water and the like to the drum inside from a front lower portion of the drum, the rim 101 of the tub front 100 may be formed in a lower portion of the front surface 112. if it is necessary to supply the wash water and the like in a right and left direction, not in the upward and downward direction mentioned above, the rim 101 may be formed in a inner corner center portion 131 of the front surface 112. That is, the appearance of the rim 101 may be variable according to which direction the supplied fluidal material is supplied along.

A front gasket coupling part configured to couple a front gasket 200 to the front tub 100, which will be described later, thereto may be formed in a front end of the rim 101. The front gasket coupling part may be extended forward from the front end of the rim 101 in a relatively short length and it may have a proximately cylindrical shape. A rib 102*a* may be formed on an outer circumferential surface of the front gasket coupling part and the rib 102*a* maybe a single rib continuously formed along the outer circumferential surface of the front gasket coupling part 102 and it may be getting longer downward from the top of the tub front 100. This is the result of the consideration of the interference of the front gasket 200 with a front cabinet seating part (213, see FIG. 12), which will be described later.

The front gasket (200, see FIG. 1) which will be described in detail later may be coupled to the tub front 100 after the front gasket coupling part of the tub front 100 is inserted insertedly coupled to the front gasket 200. Because of that, the front gasket 200 may include an inserting groove in which the cylindrical surface having the rib 102*a* formed thereon can be inserted and this configuration will be described in detail later.

Figure 12:
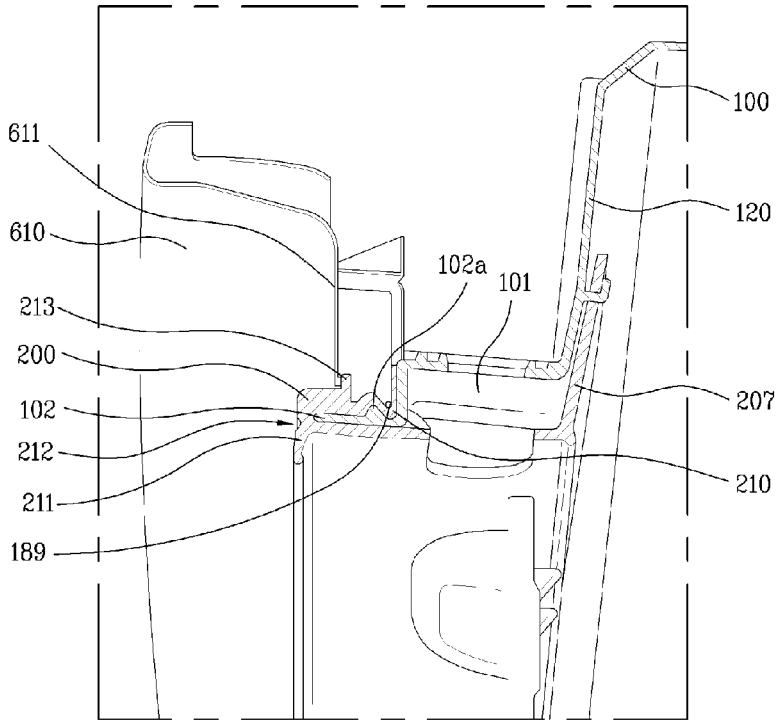
FIG. 12 is a partially enlarged sectional view illustrating a connection relation between the front gasket and the tub.

In the meanwhile, the tub front 100 may be fixedly connected with a cabinet front (610, see FIG. 12). For this fixedly connected state, a plurality of, for example, four securing bosses 107 may be formed in the front part 112 of the tub front 100, approximately surrounding the rim 101. According to the installation order, after the cabinet front 610 is located with the tub front 100 installed in its position, screws may be fastened in a forward and backward direction.

A rear wall of the tub rear 120 may be fixedly connected to the cabinet and the tub front 100 and/or the tub rear 120 may be seated on the base to be supported by the base.

Figure 4:
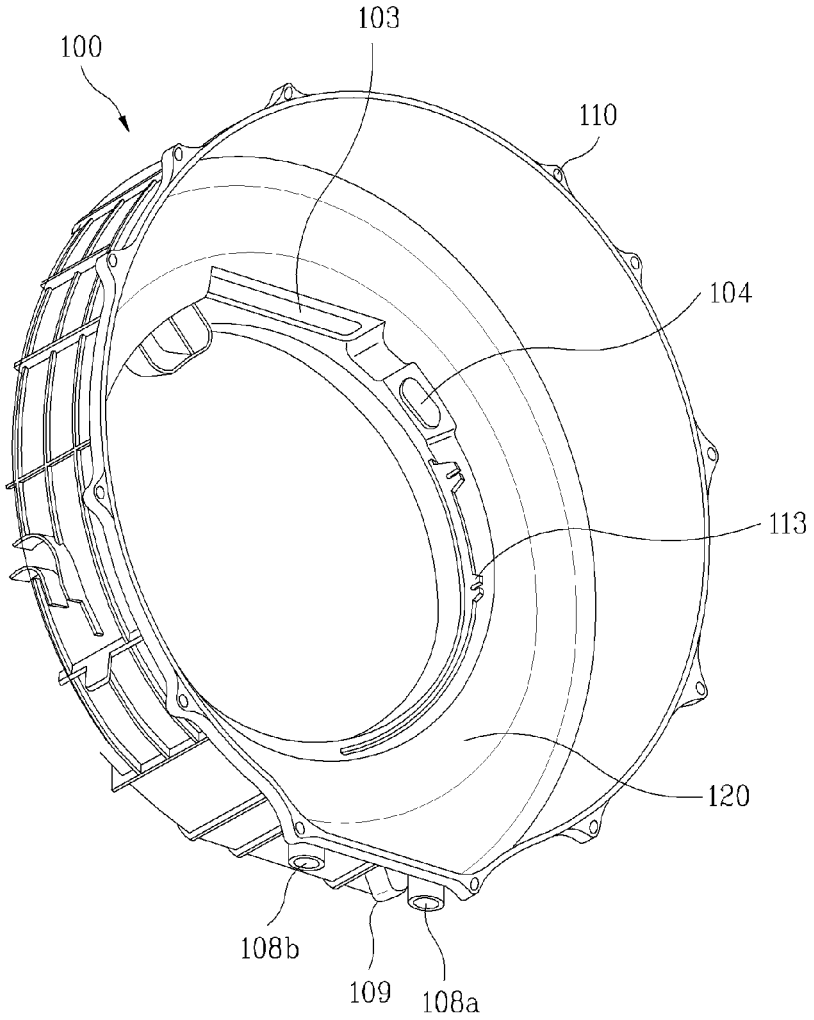
FIG. 4 is a rear perspective view illustrating the tub front.

FIG. 4 is a perspective view illustrating an inside of the tub front 100, seen in the back.

In reference to FIG. 4, a steam inlet (105, see FIG. 3) may be connected with a steam hose and a steam guide (105*a*, see FIG. 10) may be provided in the tub front 100 to guide the steam drawn via the steam inlet 105 toward the drum inside. Also, a circulating-water guide (106*a*, see FIG. 10) may be provided in the front tub 100 to guide circulating water drawn via a circulating-water inlet (106, see FIG. 3) toward the drum inside. These steam inlet 105, circulating-water inlet 106, steam guide 105*a* and circulating-water guide 106*a* may be integrally formed with the tub front 100. For example, the tub front may be fabricated to be plastic-injection mold and these elements including the steam inlet 105 and etc. may be injection-molded together as parts of the tub front 100.

In the meanwhile, a base coupling part may be formed in a lower surface of the tub front 100 to seat the tub front 100 on the cabinet base. The base coupling part may include a first hollow coupling part 108*a* and a second hollow coupling part 108*b* which are formed as hollow cylinders, and it may further include a first screw coupling part 109 for screw coupling. After the tub front 100 is located on the base 600, a screw is fastened via the first screw coupling part 109 in a forward and backward direction to fixedly couple the tub front 100 to the base 600.

As mentioned above, the tub front 100 may be coupled with the tub rear 120 to form the predetermined space having the drum received therein. In this case, the tub front 100 and the tub rear 120 may be screw-fastened to each other and a plurality of screw-securing holes 110 may be formed along a circumference of the rear part of the tub front.

Figure 5:
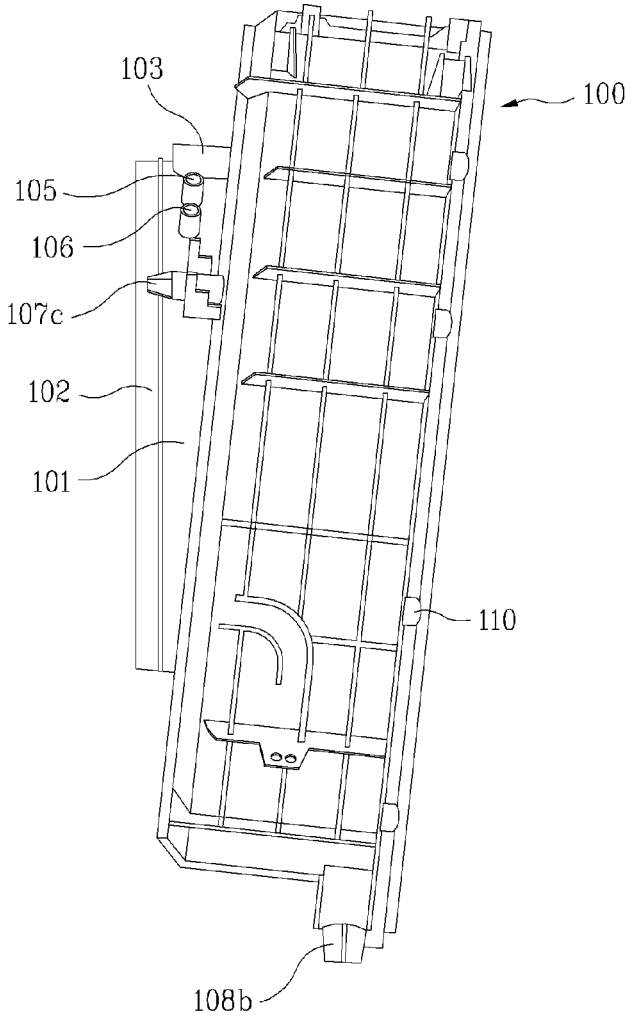
FIG. 5 is a side view illustrating the tub front.

FIG. 5 is a side view illustrating the tub front 100.

In reference to FIG. 5, the cylindrical surface of the tub front 100 configured to surround the drum may be tilted upward. According to this embodiment, a front part of the drum may be tilted toward. Because of that, the cylindrical surface of the tub configured to surround the drum may be tilted upward, too.

As mentioned above, the rim 101 of the tub front 100 may have the width which is getting narrower downward from the top of the rim 101. If the tub front 100 is tilted upward, the shape of the rim 101 with the downwardly narrower width enables the opening of the tub to face forward, not tilted. The laundry is loaded and unloaded via the opening. That is, the opening of the tub configured to introduce the laundry into the laundry machine may be formed perpendicularly. Alternatively, the opening of the tub may be formed obliquely backward at a predetermined angle.

As follows, the front gasket coupled to the tub front mentioned above will be described in reference to corresponding drawings.

FIGS. 6 to 12 are diagrams illustrating a front gasket 200 coupled to the front part of the tub front 100 according to an embodiment of the present.

Figure 6:
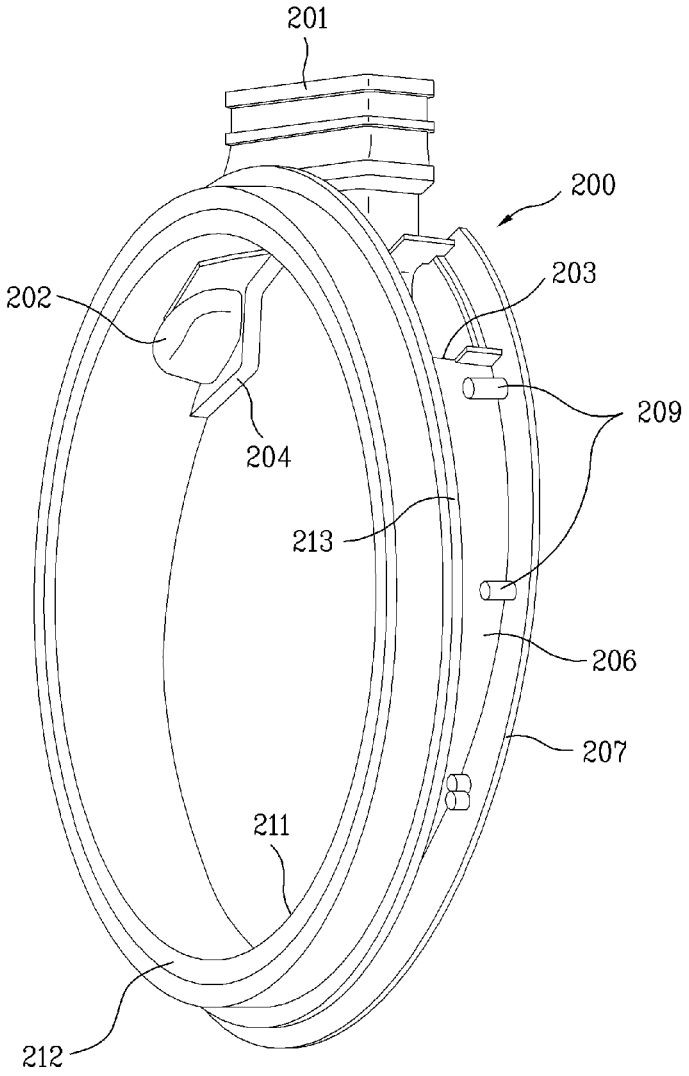
FIG. 6 is a front perspective view illustrating a front gasket.
Figure 7:
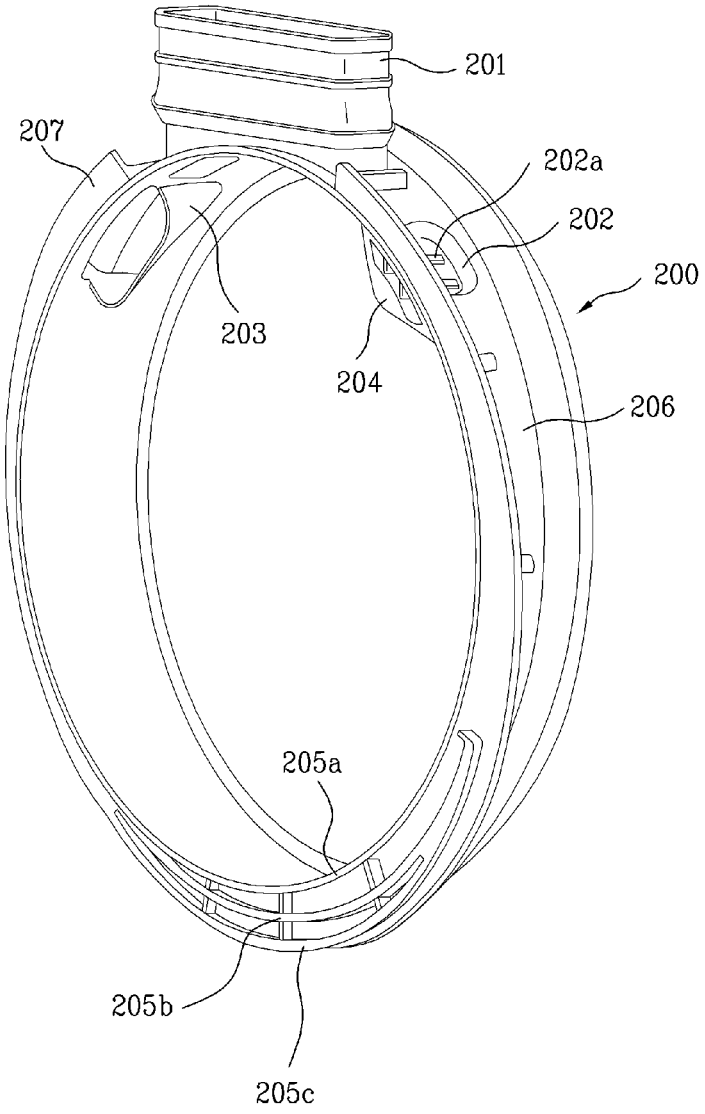
FIG. 7 is a rear perspective view illustrating the rear gasket.
Figure 8:
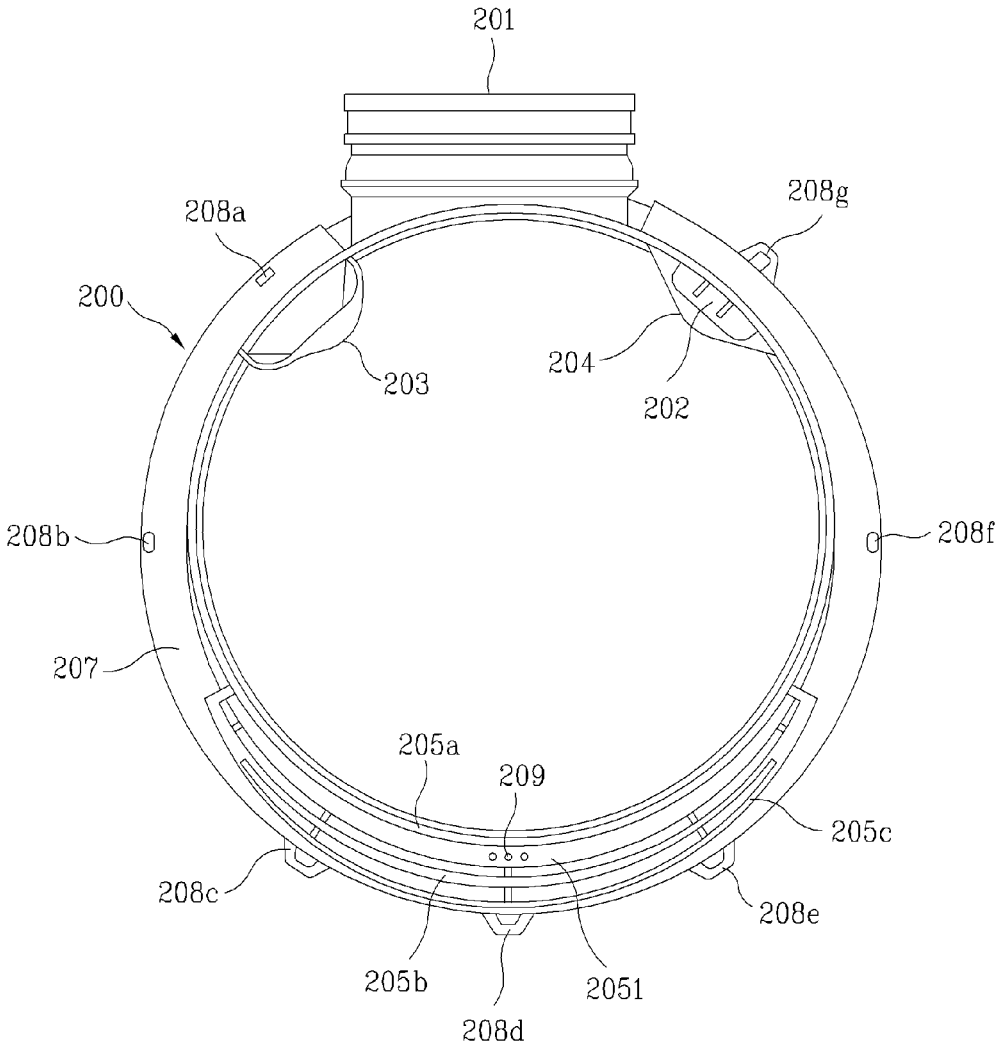
FIG. 8 is a rear view illustrating the front gasket.

FIG. 6 is a perspective view illustrating the front gasket 200, seen in the front, and FIG. 7 is a perspective view illustrating the front gasket 200, seen in the back, and FIG. 8 is a rear view illustrating the front gasket 200, seen in the back.

In reference to FIGS. 6, 7 and 8, the front gasket 200 may include a coupling part 212 seated on an outer circumference of the front gasket coupling part and a rim 206 corresponding to the rim 101 of the tub front 100. A flange 207 seated on an inner surface of the front surface 112 of the tub front 100 may be provided in the front gasket 200. As a result, the connecting portion between the flange 207 and the coupling part 217 of the front gasket 200 may be the rim 206.

In the meanwhile, the lower width of the front surface 112 composing the tub front 100 may be larger than the upper width thereof as mentioned above. As a result, the lower width of the flange 207 seated in an inner surface of the front surface 112 may be larger than the upper width thereof. This is to provide the foreign substance preventing part in the enlarged portion and the foreign substance preventing part will be described in detail later.

The front gasket 200 may include a first coupling part configured to secure the flange 207 with the inner surface of the front surface 112 composing the tub front 100. here, the first coupling part may include a protrusion (111, see FIG. 9) formed in the inner surface of the front surface 112 composing the tub front 100 and a coupling hole 208 provided in the flange. Alternatively, it is possible to form a protrusion in the flange 207 and a coupling hole in the inner surface of the front surface 112 composing the tub front 100.

A front portion of the front gasket 200 may be coupled to the tub via the coupling part 212 and a rear portion thereof may be coupled to the tub via the flange 207. The flange 207 may be used to suspend the shock, in case a front end of the drum collides against the inner surface of the front part 112 of the tub.

A duct connecting part 201 which will be connected with a drying duct 40 may be formed in an upper portion of the rim 206 and the duct connecting part 201 may be inserted in a hot air inlet 103 of the tub front 100. The hot air blown through the drying duct (not shown) may be supplied to the tub inside via the duct connecting part 201. Here, the laundry machine having washing and drying functions may not require the drying duct connecting part 201. if the hot air inlet 103 formed in the rim 101 of the tub front 100 is provided, even a laundry machine, not the one having the washing and drying functions, may include a duct connecting part 201 having a closed, not hollow, shape and the hot air inlet 103 may be closed. That is, the appearance of the front gasket 200 may be changeable based on whether the drying function is provided or not.

A water supply guide 202 corresponding to the water supply inlet 104 of the tub front 100 may be formed in the rim 206 of the front gasket 200 and the water supply guide 202 may guide wash water into the drum. For example, the water supply guide 202 may have a sectional shape of approximately 'L' and a partition wall 202*a* may be formed in the water supply guide 202.

A laundry stopper 204 may be formed in rear of the water supply guide 202 to stop the laundry from getting out of the drum. The laundry rotated inside the drum might be pushed forward and the laundry stopper 204 is used to stop the escaping of the laundry. Here, the laundry stopper 204 could contact with the laundry and it may be approximately triangle-shaped not to interfere with the rotation of the laundry.

Figure 10:
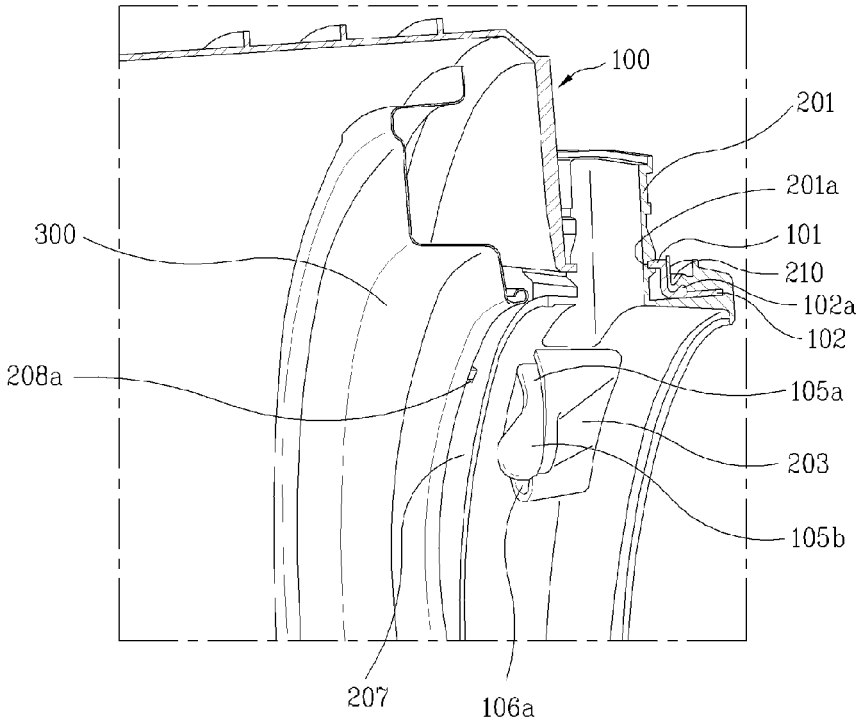

According to FIG. 10, a projected part 105*b* is seen in a lower surface of the circulating-water guide 106*a* and the projected part 105*b* may be functioned as the laundry stopper 204.

The front gasket 200 may include a guide cover part 203 formed to cover the steam guide 105 and the circulating-water guide 106*a* of the tub front 100.

Figure 9:
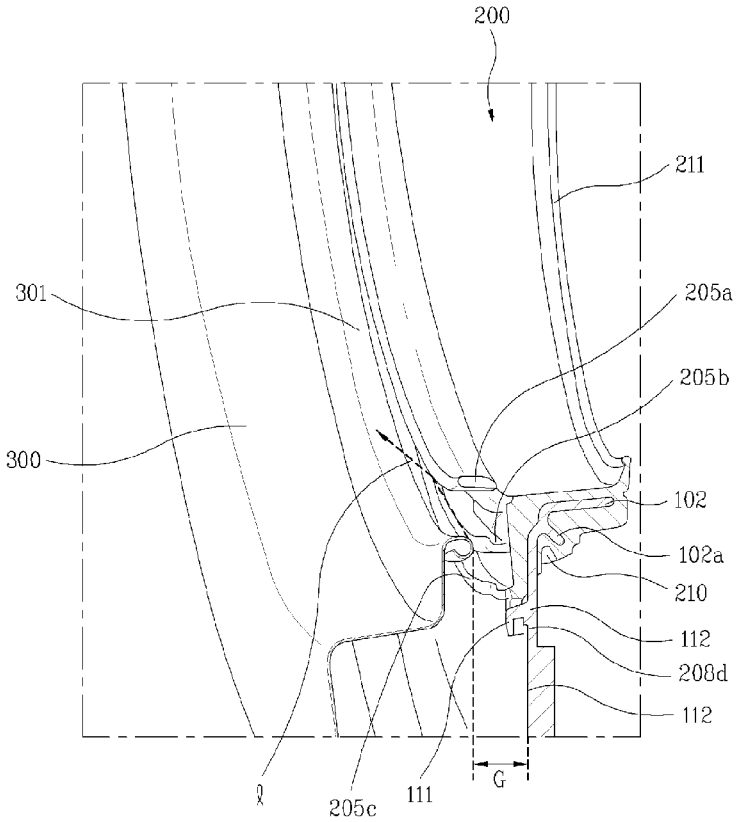
FIGS. 9 and 10 are partially enlarged sectional view illustrating a connection relation between the front gasket and a tub.

The coupling hole 208 may be formed in the flange 207 to be hooked to the protrusion (111, see FIG. 9) formed in the inner surface of the tub front 100. FIG. 9 shows the coupling specifically.

In the meanwhile, the front gasket 200 may include a second coupling part configured to connect the rim 206 with the tub front 100. The second coupling part may include a slide-engaging protrusion 209 provided in the rim 206 and a slide-engaging recess (113, see FIG. 4) provided in the inner surface of the tub front 100, corresponding to the slide-engaging protrusion 209. Alternatively, it is possible to form a slide-engaging recess in the rim 206 and a slide-engaging protrusion in the inner surface of the tub front 100. As the front gasket 200 is moved forward from the inside of the tub, the slide-engaging protrusion 209 may be inserted in the slide-engaging recess 113.

In the meanwhile, the front gasket mentioned above may be fabricated to perform a single function or plural ones. This embodiment presents that a single front gasket may perform various functions together but a plurality of front gaskets may be provided independently according to corresponding functions. Each of the functions may be independent and it is not necessary for one of the functions to be depending on another.

First of all, a foreign substances preventing function of the front gasket 200 will be described. This foreign substance preventing function is used to prevent foreign substances, for example, the laundry, coins placed in the laundry and the like from stuck or drawn between the tub and the drum.

As shown in FIG. 9, there may be a shaft-direction gap (G) between the tub and the drum of the laundry machine according to this embodiment. That is, an inner surface of the front part 112 of the tub and a front end of the drum may be distant from each other a predetermined distance in the shaft direction. The front gasket 200 prevents foreign substances from drawn into the drum via the shaft-direction gap (G).

As follows, this foreign substance preventing function will be described in detail In reference to FIG. 8 again, the front gasket 200 may include a foreign-substance-stuck-preventing part (foreign-substance preventing part) is located in the shaft-direction gap and the foreign-substance preventing part may be projected backward. Here, the foreign-substance preventing part may include a plurality of ribs projected from a rear surface of the flange 207 and there may be provided at least three ribs, for example, first second and third ribs 205*a*, rib 205*b* and 205*c* which may be named after the order from the top or after an the order as coming farther from the center of the front gasket 200.

According to the length of each first, second and third rib 205*a*, 205*b* and 205*c* will be described, the length may be shorter as coming more downward or farther from the center of the front gasket 200. As a result, the first rib 205*a* may be projected more backward than the other ribs located there below or outer. Since the drum of the laundry machine according to the present invention may be tiled upward, a lower portion of the front end of the drum may be moved forward. Because of that, the second rib 205*b* and the third rib 205*c* may be shorter than the first rib 205*a* in consideration of interference with the forwardly moved lower portion of the drum front end 301.

As foreign substances could be drawn via the lower portion of the drum front end 301 mostly, the ribs may be formed only in a lower portion of the flange 207. In case some of the ribs are formed in an upper portion, the number of the ribs formed in the lower portion may be larger than the number of the ribs formed in the upper portion of the flange 207. As mentioned above, the lower width of the flange 207 composing the front gasket 200 may be larger than the upper width thereof. Correspondingly, the lower width of the front surface 112 composing the tub front 100 in which the flange 207 is seated may be larger than the upper width thereof. Of course, the ribs may be formed in the upper and lower portions equally and more ribs may be formed in the upper portion.

FIG. 9 is a sectional view illustrating the connection between the front gasket 200 and the front end 301 of the drum 300. In reference to FIG. 9, the foreign substance preventing part will be described in detail.

In reference to FIG. 9, the first rib 205*a* may be located inner to a radial direction with respect to the opening of the drum. A plurality of reinforcing ribs (2051, see FIG. 8) connected with the flange 207 may be formed in each of lower surfaces of the first, second and third ribs 205*a*, 205*b* and 205*c*. The reinforcing ribs 2051 may be employed to support the first, second and third ribs 205*a*, 205*b* and 205*c* and to prevent them from moving downward.

A radius of the first rib 205*a* may be smaller than a radius of the drum front end 301 and it may be extended to a predetermined portion in rear of the drum front end 301. Specifically, the first rib 205*a* may be extended from a predetermined portion upper than the lower part of the drum front end 301 to be in rear of the drum front end 301. That is, the first rib 205*a* may be extended to the drum inside, with maintaining a predetermined distance with the drum front end 301. At this time, the extended length of the first rib 205*a* may be limited mot to contact with the drum front end 301, considering a locus of the vertical rotation made by the drum front end 301. as a result, when the lower part of the drum front end 301 is seen from the front of the laundry machine, with the door being open, a predetermined length of the lower part of the drum front end 301 may not be seen because of the first rib 205*a*.

The lengths of the second and third ribs 205*b* and 205*c* may be determined in consideration of downward displacement caused by the vertical rotation of the drum front end 301. That is, as the front end 301 of the drum can move forward as far as a predetermined length, the second and third ribs 205*b* and 205*c* may be shorter. Also, the second and third ribs 205*b* and 205*c* may be distant from the drum front end 301 as far as they may not contact with the drum front end 301, in case they are rotated normally at a high speed.

The distance between the drum front end 301 and each of the first, second and third ribs 205*a*, 205*b* and 205*c* may be determined as far as the drum may not be interfered with when it is rotated normally at the high speed. Especially, the distance may be determined enough for the drum not to be interfered with in a normal rotational state at a high speed, for example, 400 rpm or higher. Over-vibration may be generated by resonance at 400 rpm or lower and this over-vibration may be temporary. Since vibration displacement is relatively large, contact between front ends of the first, second and third ribs 205*a*, 205*b* and 205*c* and the drum front end 301 will be temporary and sporadic, such that there may be little possibility of a rib abrasion problem. However, if the ribs contact with the drum front end even in the normal state of the drum rotation at 400 rpm or higher, the contact time may be continuous enough to cause the above rib abrasion problem. That is, the distance between the ribs and the drum may be determined as far as the drum may not be interfered with in the normal rotational state at the high speed and as the drum may be interfered with in the over-vibration state generated by resonance. For example, the distance may be determined as far as the drum may not be interfered with at a rotational speed of 400 rpm or higher and as the drum may be interfered with at a rotational speed of 400 rpm or lower.

The above first, second and third ribs 205*a*, 205*b* and 205*c* may be provided only in a lower part of the front gasket 200. This is because the lower portion of the drum front end 301 has a high possibility of the foreign substance and laundry stuck between the drum and the tub. As a result, the ribs may be provided corresponding to a lower-180°-area of the drum front end 301. here, the problem of the stuck laundry may occur in right and left portions of the drum front end 301. because of that, the ribs may be provided in a lower area with a range of 180° or more, for example, 180° to 270°. At this time, displacement with respect to the right and left portions of the drum front end 301 may be relatively small and the ribs may be getting shorter in an upward direction.

Here, the plurality of the ribs 205 configured for the foreign substance prevention are not necessary and the number of the ribs may be increased or decreased as the case may be.

As follows, sealing between a cabinet front (610, see FIG. 12) and the tub will be described. Here, the cabinet front 610 is a frame configured to form an exterior of the front of the laundry machine. The tub includes an opening formed in the front surface and wash water may flow via the opening, which has to be prevented.

According to the conventional laundry machine, a laundry introducing opening of the tub is spaced apart a predetermined distance from a rear portion of the cabinet front 610. This structure would make wash water flow into the cabinet via the front opening of the tub. To prevent this, the space between the front opening of the tub and the cabinet is sealed. For this sealing, a gasket is provided between the front opening of the tub and the cabinet front 610.

In contrast, according the laundry machine according to this embodiment, the front opening of the tub may be projected outside, passing through the cabinet front 610 and there is little possibility of water flowing between the cabinet and the tub. If sealing is performed between a front end of the opening formed in the tub and a door surface, especially, door glass, wash water may be prevented from flowing outside the tub via the opening when the door is closed.

For this leaking water preventing function, the front gasket 200 may include a door sealing part (211, see FIGS. 9 and 12). This door sealing part 211 may be formed adjacent to a predetermined portion of the front gasket 200 which is coupled to the opening of the tub. The door sealing part 211 may be pushed backward by the door glass (not shown) when the door is closed. To make the door sealing part 211 in close contact with the door glass to accomplish perfect sealing, it is preferable that the door sealing part 211 is supported against the pushing of the door glass. Because of that, the door sealing part 211 may be formed adjacent to the coupling portion between the front gasket 200 and the opening of the tub.

As follows, the connection relation between the front gasket and the cabinet front will be described and next the door sealing part will be described in detail.

Figure 11:
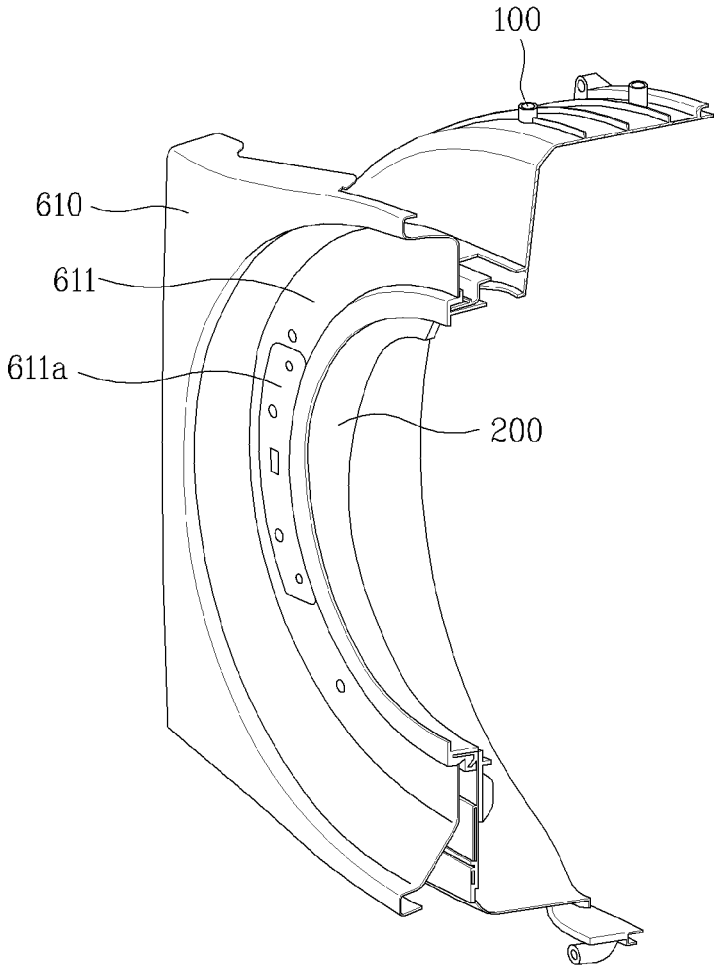
FIG. 11 is a sectional view illustrating a connection relation between a cabinet front and the front gasket.

FIG. 11 is a sectional view partially illustrating the cabinet front 610.

In reference to FIG. 11, the cabinet front 610 includes a door seating surface 611 and the door seating surface 611 is recessed backward corresponding to a door frame to seat the door therein. A door coupling part 611*a* may be formed in the door seating surface 611 and the door is coupled to the door coupling part 611*a* by a hinge. An opening corresponding to the front opening of the tub may be formed in a center of the door seating surface 611. The coupling part (102, see FIG. 12) of the tub front 100 may be projected longer than the door seating surface 611 in a forward direction. That is, the front gasket coupling part extended forwardly from the front surface toward the door may be formed in the front part of the tub and it may be projected forwardly out of the front part of the cabinet front 610. A front end of the front gasket coupling part may be projected outer than the opening of the cabinet front 610 and the front opening of the tub may be projected outer than the cabinet front 610, which is illustrated well in FIG. 12.

FIG. 12 is a sectional view partially illustrating the cabinet front 610, the tub front 100 and the front gasket 200.

As shown in FIG. 12, the front gasket 200 may be insertedly coupled to the front gasket coupling part cylindrically formed in the front part of the tub front 100. That is, the front gasket coupling part of the tub front 100 may be inserted in the coupling part 212 of the front gasket 200 to support and the door sealing part 211 is provided in the coupling part 212. Even if the door sealing part 211 is strained because of the closing of the door, this coupling structure enables the strain not transmitted to the ribs 205 provided in rear by the supporting of the front gasket coupling part. As a result, the distance between the ribs and the drum front end may be maintained as it is in a first state considered when designed. A rib 102*a* may be formed in the front gasket coupling part and the front gasket 200 may include a ring part 210 located in rear of the rib 102*a*. A corrugation is formed in the ring part 210 and a coupling ring 189 configured to front gasket 200 to the tub front 100 may be inserted in the corrugation.

The front part of the front gasket 200 may be coupled to the coupling part 02 of the tub front 100 via the coupling part 212 of the front gasket 200. In this case, the door sealing part 211 may be extended from an inner circumference of the coupling part 212 toward an inside of a radial direction. The connection relation between the coupling part 212 of the front gasket 200 and the front gasket coupling part of the tub front 100 will be described. The coupling part 212 of the front gasket 200 is seated in an outer circumference of the front gasket coupling part and in this state, the coupling ring 189 presses to fix the coupling part 212. After that, a recess is formed in the outer circumference of the front gasket coupling part 102 and a predetermined part of the coupling part 212 and the coupling ring 189 may be located in the recess. The recess may be formed by the rib 102*a* formed in the outer circumference of the front gasket coupling part 102 and a wall of the rim 101 of the tub 100 located in rear of the rib 102*a*.

The opening of the cabinet front 610 may be seated in an outer circumferential surface of the coupling part 212 and a seating part 213 projected outward with respect to a radial direction is formed in the coupling part 212 and the seating part 213 is seated in an inner surface of the opening formed in the cabinet front 610.

Since the front gasket coupling part 102 of the tub front 100 is projected longer than the door seating surface 611 forwardly, the front end of the front gasket coupling part 102 may be closer to the door glass. As a result, the door sealing part 211 extended from the coupling part 12 connected to the front gasket coupling part 102 may be located clot to the door glass, too. In case the door sealing part 211 is pushed by the door glass, the door sealing part 211 of the front gasket 200 may be short and simple. Also, four portions of the front surface 112 of the tub front 100 may be fixedly secured with the door seating surface of the cabinet front 610. That is, the coupling bosses (107, see FIG. 2) provide in the front surface 112 of the tub front 100 may be coupled to the cabinet front 610 by screws. As the door is closed, the door sealing part 211 is supported to the tub front 100 secured to the cabinet front 610 to support the rear pushing. Because of that, the sealing of the door glass may be secured.

The door sealing part 211 is located adjacent to the door glass, the door sealing part 211 may be in close contact with the door glass and the front gasket 200 may not be fixedly secured with the cabinet front 610 accordingly. That is, the front gasket 200 may be in contact with the cabinet front 610 in a non-contact type.

Figure 13:
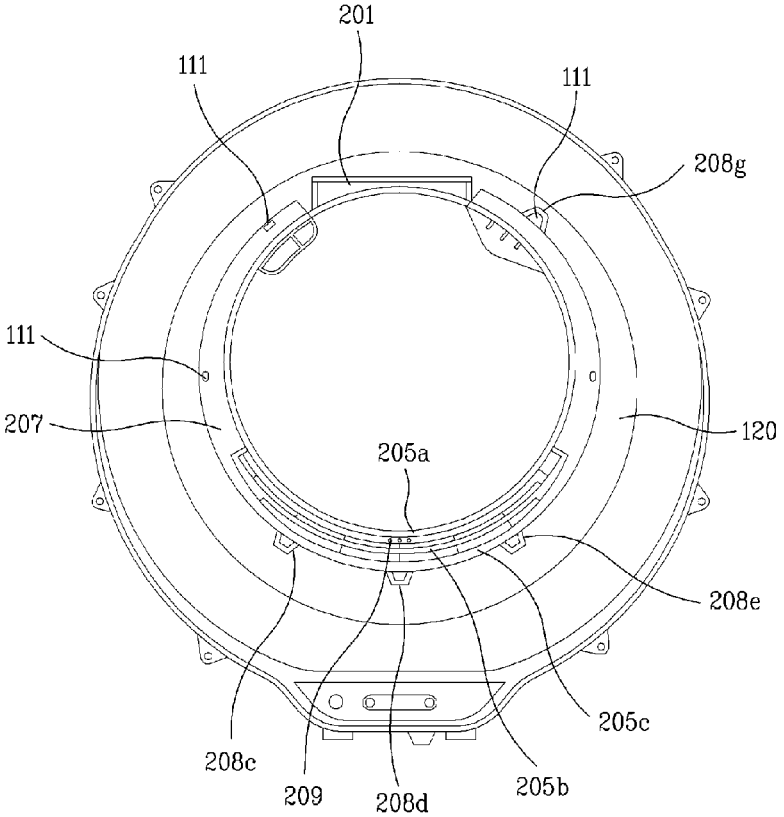
FIG. 13 is a rear view illustrating the front gasket connected to the tub front.

FIG. 13 is a rear view illustrating the front gasket 200 coupled to the tub front 100, seen in the rear. At this time, the opening of the tub front is insertedly coupled to the front part of the front gasket 200.

In reference to FIG. 13, an oblique surface 120 may be formed in an inner surface of the front surface 112 composing the tub front 100. The flange 207 of the front gasket mentioned above may be seated on the oblique surface 120. The oblique surface 120 may be oblique to be projected forward as coming closer to a center with respect to a radial direction. The drum front end 301 rotatably moves in an upward and downward direction. Especially, when a lower portion of the drum front end 301 is rotatably moved to be displaced downward, the distance between the inner surface of the front surface 112 composing the tub front 100 and the drum front end 301 is reduced as much as possible to prevent foreign substances or laundry from being stuck in the distance.

In the meanwhile, the plurality of coupling holes 208*a*~208*g*) provided in the flange 207 may be inserted in the protrusions 111 provided in the rear surface of the tub front 100, respectively. The lower part of the front gasket 300 may be coupled by an engaging type or hooking type. An upper part of the front gasket 200 may be coupled by a sliding inserting type. As a result, the coupling holes 208*a*~208*g* may be formed in the front gasket 200 and the protrusions 111 insertedly hooked to the coupling holes such as hooks may be formed in the inner surface of the front surface 112 composing the tub front 100. for the slidingly inserting type, the slide engaging protrusions 209 provided in the rim 206 of the front gasket 200 may be sliding-inserted in and engaged to the engaging recesses 113 provided in the inner surface of the rim 101 of the tub front 100. the slide engaging protrusion may be formed in 'T' or '⊤' shape.

Figure 14:
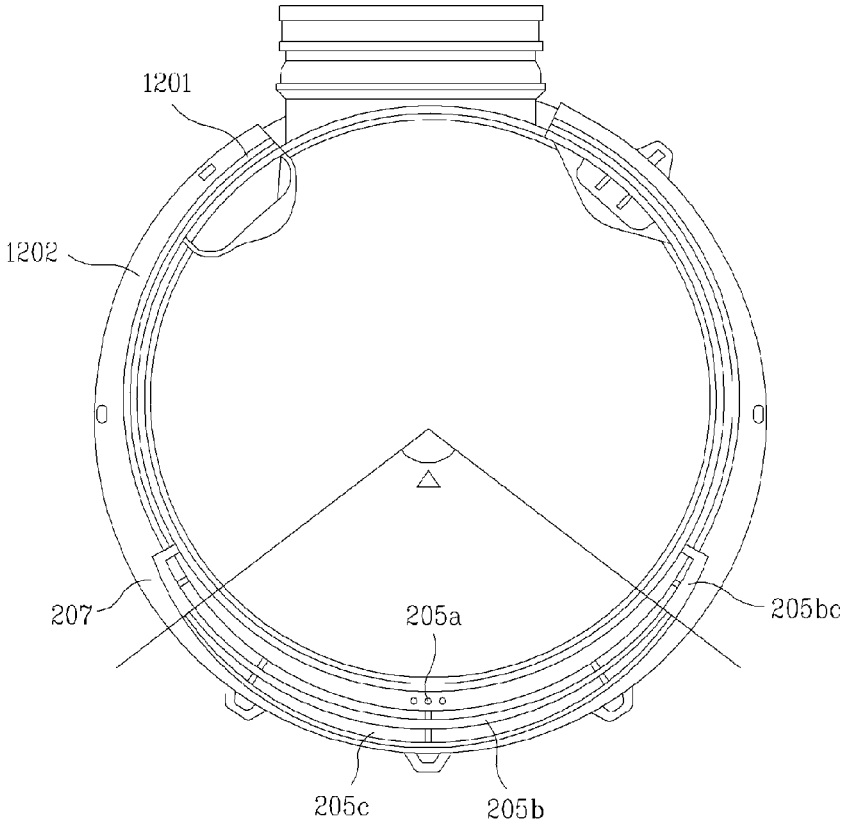
FIG. 14 is a rear view illustrating a front gasket according to another embodiment of the present invention.

In the meanwhile, an auxiliary rib functioned as the above ribs 205 may be provided and this configuration will be described in reference to FIGS. 14, 15 and 16.

In reference to FIG. 14, a fourth rib 1201 may be further extended backward from the flange 207. the fourth rib 1201 may be formed in an upper-180°-area of the flange 207. the fourth rib 1201 may be formed in a lower area of the upper-180°-area. in case the area of the fourth rib 1201 is overlapped with the area of the first rib 205*a*, the fourth rib 1201 may be located below the first rib 205*a*, that is, outer than the first rib 205*a*.

A pair of fifth ribs 1202 may be further provided to surround the fourth rib 1201. The fifth rib 1202 may be connected with the second or third rib 205*b* or 205*c* to be continuously formed until an upper cut portion of the flange 207. Here, the second and third ribs 205*b* and 205*c* may include a connection part 205*bc* connected by the second and third ribs 205*b* and 205*c*. In this case, the fifth rib 1202 may be connected with the connection part 205*bc*.

Figure 15:
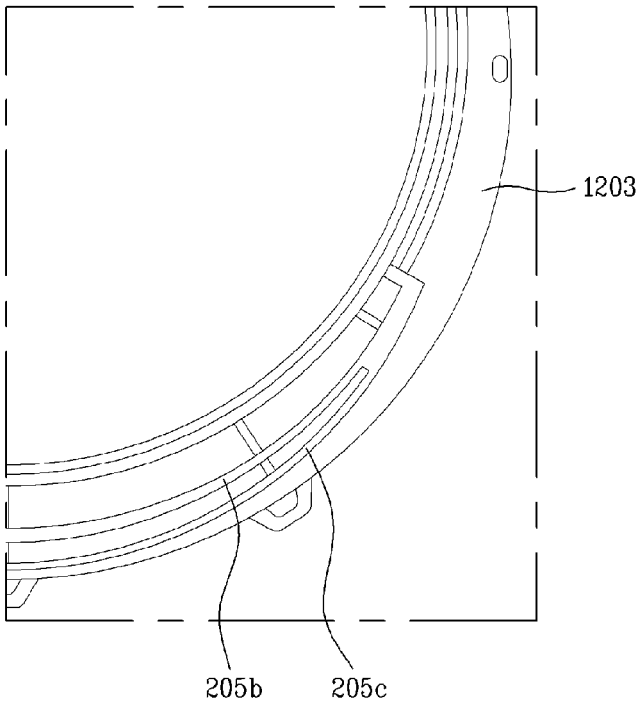
FIG. 15 is a rear view illustrating a front gasket according to a further embodiment of the present invention.

In reference to FIG. 15, a sixth rib 1203 may be formed to surround the third rib 205*c* and the sixth rib 1203 may be formed with a lower-180°-area of the flange 207.

In reference to FIG. 14 again, the lower portion of the drum front end 310 will have a high possibility of foreign substance stuck between the drum and the tub. Since the drum front end 310 can be displaced vertically, at least three steps of plural ribs may be provided in a predetermined range (Δ) of angles with respect to the lower portion of the front gasket 200. As shown in FIG. 14, the angle range (Δ) may be a 120° range and the rib formed in the range may have 5 steps. The above ribs configured to compensate the distance between the drum and the tub to prevent the foreign substances stuck between the drum and the tub may be ribs having 2 steps or more corresponding to an overall area of the drum front end. All of these ribs may be formed in the front gasket and a predetermined number of ribs may be formed in the inner surface of the front surface of the tub front.

Figure 16:
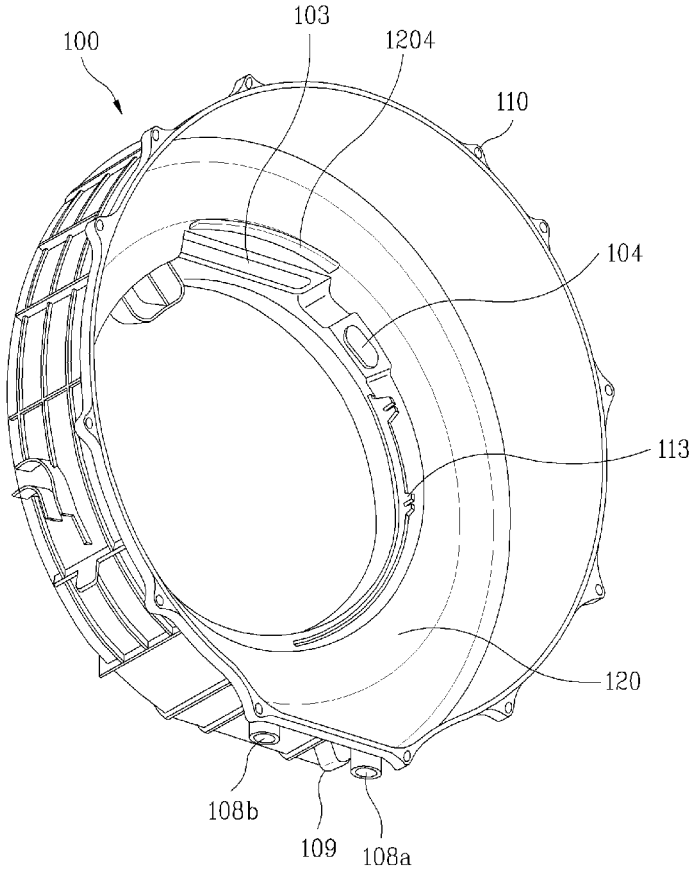
FIG. 16 is a rear view illustrating a tub front according to another embodiment of the present invention.

FIG. 16 illustrates a rear surface of a tub front 100 according to another embodiment of the present.

In reference to FIG. 16, a predetermined upper portion of the flange 207 may not be formed in consideration of interference with a duct connecting part corresponding to the hot air inlet 103 of the tub front 100. Because of that, an upper portion of the fifth rib (1202, see FIG. 14) mentioned above seems like a cut portion. A tub gap compensating rib 1204 which can replace the cut portion of the fifth rib 1202 may be formed in the inner surface of the front surface of the tub front 100 to cover the cut portion of the fifth rib 1202. FIG. 16 illustrates arrangement of the tub gap compensating rib 1204, the fourth rib 1201 and the fifth rib 1202.

The ribs mentioned above may be formed along the circumference continuously or intermittently with predetermined cut portions.

Figure 17:
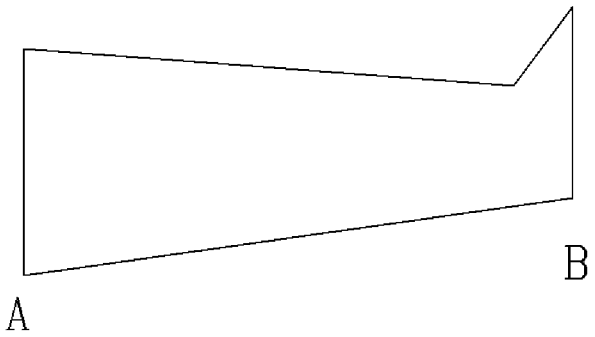
FIG. 17 is a sectional view illustrating ribs provided in the front gasket.

FIG. 17 is a sectional view of the ribs.

In reference to FIG. 17, according to a sectional shape of the ribs, the thickness of the portion (A) of which meets the flange 207 may be getting smaller toward an end portion (B). The end portion (B) may be bent inwardly with respect to a radial direction. Since the thickness of the end (B) is smaller, the length of the end portion may be smaller. This case may be disadvantageous to prevent the foreign substances. Because of that, the end portion is bent to secure a predetermined length of the end portion and the thickness of the end portion (B) is smaller than the connected portion (A) with the flange, which is relatively advantageous to reduce a problem of abrasion because the end portion can be flexibly transformed even in case of contacting with the drum. The thickness of the portion connected with the flange is relatively larger and this is advantageous to maintain the location of the end of the tub as it is designed.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The present invention has an industrial applicability.

The invention claimed is:

1. A laundry machine comprising:

a front cabinet comprising an opening;

a tub comprising a front surface formed therein to load laundry therein, and the front surface of the tub is fixedly coupled to the front cabinet;

a drum rotatably provided in the tub, the drum having an opening formed therein to load the laundry therein; and a gasket provided between the front surface and the front cabinet and configured to seal the front surface and the front cabinet and comprising a flange extended along a radial direction and provided to be seated in the inner surface of the front surface of the tub and a plurality of ribs provided between an inner surface of the front surface part of the tub and a front end of the opening of the drum, the plurality of ribs being spaced at a predetermined interval and arranged along a radial direction formed in a rear portion of the flange.

2. The laundry machine as claimed in claim 1, wherein the plurality of the ribs comprise at least three ribs.

3. The laundry machine as claimed in claim 2, wherein the plurality of the ribs are provided in a rear bottom portion of the flange provided in the gasket.

4. The laundry machine as claimed in claim 2, wherein the plurality of the ribs are provided to correspond a 180° to 270° area of a rear bottom portion of the flange provided in the gasket.

5. The laundry machine as claimed in claim 2, wherein the plurality of the ribs is getting shorter upward from a lower portion of the gasket, respectively.

6. The laundry machine as claimed in claim 2, wherein the ribs provided in the lower portion of the gasket are more than the ribs provided in the upper portion of the gasket.

7. The laundry machine as claimed in claim 1, wherein the plurality of the ribs comprises a first rib, a second rib and a third rib provided sequentially from a center of the gasket.

8. The laundry machine as claimed in claim 7, wherein the ribs are getting shorter as coming farther from the center of the gasket.

9. The laundry machine as claimed in claim 7, wherein the first rib is longer than the second and third ribs.

10. The laundry machine as claimed in claim 9, wherein the first rib is extended a predetermined distance toward an inside of the opening provided in the drum.

11. The laundry machine as claimed in claim 9, wherein the first rib is extended beyond the front end of the drum.

12. The laundry machine as claimed in claim 9, wherein the first rib has a predetermined length enough to cover a predetermined portion of the front end of the drum.

13. The laundry machine as claimed in claim 9, wherein the length of the first rib is determined enough not to interfere with a locus of a upward and downward movement generated by the rotation of the drum.

14. The laundry machine as claimed in claim 9, wherein each of the first, second and third ribs has a predetermined length enough not to contact with the front end of the drum in case the drum is normally rotated in a dry-spinning course.

15. The laundry machine as claimed in claim 9, wherein each of the first, second and third ribs has a predetermined length enough to contact with a predetermined portion of the front end of the drum, in case the drum is transient state-rotated in a dry-spinning course, and not to contact the front end of the drum, in case the drum is normally rotated.

16. The laundry machine as claimed in claim 9, further comprising a reinforcing rib configured to support the first, second or third rib in an outer direction of the third rib.

17. The laundry machine as claimed in claim 7, further comprising a fourth rib provided in a upper 180° area to 270° area of a rear portion of the flange.

18. The laundry machine as claimed in claim 17, wherein the fourth rib is outer than the first rib in case the fourth rib is overlapped with the area of the first rib.

19. The laundry machine as claimed in claim 18, further comprising a fifth rib configured to surround the fourth rib.

20. The laundry machine as claimed in claim 19, wherein the fifth rib is connected with the second rib or third rib, to be extended backward to a rear top of the flange.

21. The laundry machine as claimed in claim 20, wherein in case a connection part is provided connecting ends of the second rib and third rib, the fifth rib is connected with the connection part.

22. The laundry machine as claimed in claim 19, further comprising a sixth rib configured to surround the fifth rib.

23. The laundry machine as claimed in claim 22, wherein the sixth rib is formed corresponding to a lower 180° area of a rear part of the flange.

24. The laundry machine as claimed in claim 19, further comprising a compensating rib provided in an inner surface of the front surface of the tub to compensate a cut length of the fifth rib, in case the fifth rib is cut because a top of the flange has a cut length.

25. The laundry machine as claimed in claim 1, wherein the plurality of the rib is arranged in at least three steps in a predetermined angle area of a lower part of the gasket.

26. The laundry machine as claimed in claim 1, wherein the plurality of the ribs is arranged in two steps or more, corresponding to an overall front end of the drum.

27. The laundry machine as claimed in claim 1, wherein each sectional shape of the ribs has a smaller thickness from a connected portion with the flange toward an end portion.

28. The laundry machine as claimed in claim 27, wherein each end of the ribs is bent inwardly with respect to a radial direction.

29. The laundry machine as claimed in claim 1, a width of a lower part of the flange is larger than a width of an upper part thereof.

30. The laundry machine as claimed in claim 1, further comprising:

a shaft connected with the drum;

a bearing housing configured to rotatably support the shaft;

a motor configured to rotate the shaft; and a suspension unit connected with the bearing housing and configured to suspend vibration of the drum.

31. The laundry machine as claimed in claim 1, further comprising:

a driving part in which the shaft connected with the drum, the bearing housing configured to rotatably support the shaft and the motor configured to rotate the shaft are provided; and a sealing material configured to seal a rear part of the tub to prevent water from leaking to the driving part from the tub, the sealing material configured to allow the driving part to relative-move with respect to the tub.

32. The laundry machine as claimed in claim 1, further comprising a suspension unit configured to support the drum, wherein the tub is supported more rigidly than the drum is supported by the suspension unit.

* * * * *